US010912961B2

(12) United States Patent
Seo et al.

(10) Patent No.: US 10,912,961 B2
(45) Date of Patent: Feb. 9, 2021

(54) MASK HAVING ADSORPTION MEMBRANE PROVIDED THEREIN

(71) Applicant: AMOGREENTECH CO., LTD., Gimpo-si (KR)

(72) Inventors: In Yong Seo, Seoul (KR); Ui Young Jeong, Incheon (KR)

(73) Assignee: AMOGREENTECH CO., LTD., Gimpo-si (KR)

( * ) Notice: Subject to any disclaimer, the term of this patent is extended or adjusted under 35 U.S.C. 154(b) by 377 days.

(21) Appl. No.: 15/572,968

(22) PCT Filed: May 18, 2016

(86) PCT No.: PCT/KR2016/005254
§ 371 (c)(1),
(2) Date: Nov. 9, 2017

(87) PCT Pub. No.: WO2016/195287
PCT Pub. Date: Dec. 8, 2016

(65) Prior Publication Data

US 2018/0117370 A1 May 3, 2018

(30) Foreign Application Priority Data

Jun. 1, 2015 (KR) ..... 10-2015-0077320

(51) Int. Cl.
*A62B 23/02* (2006.01)
*A41D 13/11* (2006.01)

(52) U.S. Cl.
CPC ..... *A62B 23/025* (2013.01); *A41D 13/11* (2013.01); *A41D 13/1192* (2013.01)

(58) Field of Classification Search
CPC ..... A62B 11/00; A62B 15/00; A62B 19/00; A62B 29/00; A62B 23/025; B01D 2257/91; A61F 2013/8429
(Continued)

(56) References Cited

U.S. PATENT DOCUMENTS 6,827,764 B2 * 12/2004 Springett ..... A41D 13/1146 264/239
8,292,090 B2 * 10/2012 Kools ..... B01D 67/0009 210/490
(Continued)

FOREIGN PATENT DOCUMENTS

KR 2019990039443 11/1999
KR 100931407 12/2009
(Continued)

OTHER PUBLICATIONS

Huang, ION Exchange Membrane and Filter Module Using Same, WIPO IP Portal, 2013 (Year: 2013).*
(Continued)

*Primary Examiner* — Tarla R Patel
(74) *Attorney, Agent, or Firm* — Cantor Colburn LLP

(57) ABSTRACT

Provided is a mask having a built-in adsorptive membrane, the mask including: a mask body having the built-in adsorptive membrane for adsorbing foreign substances contained in air; and a hanger band fixed to the mask body to be hung and fixed to the ear, wherein the adsorptive membrane comprises: a support member having a plurality of first pores; and a first adsorptive member that is stacked on the support member and has a plurality of second pores formed therein and that is made by accumulating ion exchange nanofibers for adsorbing ionic foreign substances in the foreign substances.

10 Claims, 5 Drawing Sheets

(58) Field of Classification Search
USPC ..... 128/863
See application file for complete search history.

(56) References Cited

U.S. PATENT DOCUMENTS

| | | | | |
|---|---|---|---|---|
| 2003/0168401 | A1* | 9/2003 | Koslow | B01D 39/2017 210/500.25 |
| 2008/0264258 | A1* | 10/2008 | Mares | B01D 39/1623 96/131 |
| 2012/0180800 | A1* | 7/2012 | Shibata | A41D 13/113 128/863 |
| 2016/0015098 | A1* | 1/2016 | Conlon | A41D 13/1192 128/863 |
| 2016/0369439 | A1* | 12/2016 | Isele | A61F 13/15203 |
| 2018/0185678 | A1* | 7/2018 | Lee | C08G 67/00 |

FOREIGN PATENT DOCUMENTS

| | | | | |
|---|---|---|---|---|
| KR | 101130788 | | 4/2012 | |
| KR | 20140002111 | | 1/2014 | |
| KR | 20140139176 | | 12/2014 | |
| KR | 20140139176 | A * | 12/2014 | |
| KR | 20150054394 | | 5/2015 | |
| WO | WO-2015072731 | A1 * | 5/2015 | B01J 47/12 |

OTHER PUBLICATIONS

Jeon, Air cleaning filter and method for preparing the same, ip.com, 2014 (Year: 2014).*
International Search Report—PCT/KR2016/005254 dated Aug. 22, 2016.

* cited by examiner

MASK HAVING ADSORPTION MEMBRANE PROVIDED THEREIN

TECHNICAL FIELD

The present disclosure relates to a mask, and more particularly, to a mask having a built-in adsorptive membrane capable of adsorbing ionic foreign substances and ultrafine foreign substances, thus improving the purification performance of contaminated air, and thereby being used as a mask for various purposes.

BACKGROUND ART

In recent years, industrialization has proceeded rapidly, and environmental changes in the earth have caused microparticles of various components to float in the air, affecting respiratory and cardiovascular diseases.

For example, the exhaust gas of automobiles, dust generated in road running of automobiles, dust sprayed from factories, and fine dust caused by yellow sand are contained in the atmosphere, and thus human breathing is very uncomfortable.

In particular, the yellow sand is the phenomenon that small sand, loess, or dust of the desert and loess in the center of the Asian continent such as China and Mongolia float in the sky, and are blown up to Korea by the upper wind, and potentially harmful particles such as magnesium, silicon, aluminum, iron, potassium and calcium are contained in the atmosphere by yellow sand.

Yellow sand can aggravate various respiratory diseases such as asthma and allergic rhinitis, so patients and elderly people can prevent disease by wearing a mask for protecting from yellow sand when going out.

The Ministry of Food and Drug Safety in Korea approves a mask for protecting from yellow sand only when masking of 80% or more of fine particles of the average 0.6 μm in particle size. Thus, masks approved by the Ministry of Food and Drug Safety in Korea can block even the fine dust.

Meanwhile, the mask is intended to prevent harmful substances in the air such as fine particles, ionic foreign substances, and bacteria from entering the human respiratory tract. The mask prevents the infection of infectious respiratory diseases in winter as well as in industrial sites where fine dust is generated. The mask is widely used as general household goods to protect the respiratory system during the spring yellow dust phenomenon.

These kinds of harmful substances in the atmosphere function as obstacles to human life which is intended to live a pleasant and healthy life. Accordingly, in order to find various solutions to purify the harmful substances in the air, studies continue to be conducted diversely and steadily, and various performance and structural masks are being developed.

The mask has a built-in device for passing and filtering contaminated air, and the use and performance of the mask are determined by the filtering device.

Korean Patent Registration Publication No. 10-0931407 discloses a fabric for an antimicrobial mask comprising a composite fabric of a three-layer structure consisting of a back layer made of a single-sided sweat transfer fabric, an intermediate layer made of nanofibers on the back layer, and a surface layer made of a general woven fabric or nonwoven fabric on the intermediate layer, which can block fine contaminants and provide antimicrobial properties, but has a disadvantage that ionic foreign substances such as heavy metal particles cannot be filtered.

In addition, a general mask has a physical filtration mechanism that filters out foreign substances larger than the pore size by controlling the micro pore size. Thus, when the pore size is made very small to improve the filtration performance, the flow rate is made small. Therefore, there is a problem that it is difficult to breathe.

DISCLOSURE

Technical Problem

In recent years, industrialization has proceeded rapidly, and environmental changes in the earth have caused microparticles of various components to float in the air, affecting respiratory and cardiovascular diseases.

For example, the exhaust gas of automobiles, dust generated in road running of automobiles, dust sprayed from factories, and fine dust caused by yellow sand are contained in the atmosphere, and thus human breathing is very uncomfortable.

In particular, the yellow sand is the phenomenon that small sand, loess, or dust of the desert and loess in the center of the Asian continent such as China and Mongolia float in the sky, and are blown up to Korea by the upper wind, and potentially harmful particles such as magnesium, silicon, aluminum, iron, potassium and calcium are contained in the atmosphere by yellow sand.

Yellow sand can aggravate various respiratory diseases such as asthma and allergic rhinitis, so patients and elderly people can prevent disease by wearing a mask for protecting from yellow sand when going out.

The Ministry of Food and Drug Safety in Korea approves a mask for protecting from yellow sand only when masking of 80% or more of fine particles of the average 0.6 μm in particle size. Thus, masks approved by the Ministry of Food and Drug Safety in Korea can block even the fine dust.

Meanwhile, the mask is intended to prevent harmful substances in the air such as fine particles, ionic foreign substances, and bacteria from entering the human respiratory tract. The mask prevents the infection of infectious respiratory diseases in winter as well as in industrial sites where fine dust is generated. The mask is widely used as general household goods to protect the respiratory system during the spring yellow dust phenomenon.

These kinds of harmful substances in the atmosphere function as obstacles to human life which is intended to live a pleasant and healthy life. Accordingly, in order to find various solutions to purify the harmful substances in the air, studies continue to be conducted diversely and steadily, and various performance and structural masks are being developed.

The mask has a built-in device for passing and filtering contaminated air, and the use and performance of the mask are determined by the filtering device.

Korean Patent Registration Publication No. 10-0931407 discloses a fabric for an antimicrobial mask comprising a composite fabric of a three-layer structure consisting of a back layer made of a single-sided sweat transfer fabric, an intermediate layer made of nanofibers on the back layer, and a surface layer made of a general woven fabric or nonwoven fabric on the intermediate layer, which can block fine contaminants and provide antimicrobial properties, but has a disadvantage that ionic foreign substances such as heavy metal particles cannot be filtered.

In addition, a general mask has a physical filtration mechanism that filters out foreign substances larger than the pore size by controlling the micro pore size. Thus, when the pore size is made very small to improve the filtration performance, the flow rate is made small. Therefore, there is a problem that it is difficult to breathe.

Technical Solution

According to an aspect of the present disclosure, there is provided a mask having a built-in adsorptive membrane, the mask comprising: a mask body having the built-in adsorptive membrane for adsorbing foreign substances contained in air; and a hanger band fixed to the mask body to be hung and fixed to the ear, wherein the adsorptive membrane comprises: a support member having a plurality of first pores; and a first adsorptive member that is stacked on the support member and has a plurality of second pores formed therein and that is made by accumulating ion exchange nanofibers for adsorbing ionic foreign substances in the foreign substances.

In addition, in the mask having a built-in adsorptive membrane according to an embodiment of the present disclosure, the mask body may have an outer skin exposed to the external air; and an inner skin fixed to the outer skin and in contact with the face, wherein the absorptive membrane may be disposed between the outer skin and the inner skin.

In addition, in the mask having a built-in adsorptive membrane according to an embodiment of the present disclosure, foreign substances contained in the air may be at least one of pathogenic microorganisms, allergens, industrial dusts, fine dusts caused by yellow sand, viruses, and bacteria.

In addition, in the mask having a built-in adsorptive membrane according to an embodiment of the present disclosure, the second pore size may be 3 μm or less.

In addition, in the mask having a built-in adsorptive membrane according to an embodiment of the present disclosure, the support member may be a nonwoven fabric or a woven fabric.

In addition, in the mask having a built-in adsorptive membrane according to an embodiment of the present disclosure, the first pore size may be larger than the second pore size.

In addition, in the mask having a built-in adsorptive membrane according to an embodiment of the present disclosure, the ion exchange nanofibers may be cation exchange nanofibers or anion exchange nanofibers.

In addition, in the mask having a built-in adsorptive membrane according to an embodiment of the present disclosure, the ion exchange nanofibers may be cation exchange nanofibers or anion exchange nanofibers, and may further include a second adsorptive member which is stacked on the first adsorptive member and has a plurality of third pores formed therein, and which is made by accumulating other ion exchange nanofibers that exchange ions of opposite polarity with those of the ion exchange nanofibers for the first adsorptive member.

In addition, the mask having a built-in adsorptive membrane according to an embodiment of the present disclosure, may further comprise a nanofiber web that is laminated on the first adsorptive member and has a plurality of pores formed therein and that is made by accumulating nanofibers containing dopamine, to which functional groups for adsorbing foreign substances are attached.

In this case, the dopamine contained nanofiber web may be provided with a wetting layer for forming a certain moisture environment of the nanofiber web.

Here, the nanofiber web may have the functional groups attached to the dopamine by a UV irradiation, a plasma treatment, an acid treatment, or a base treatment on a web prepared by electrospinning a spinning solution formed by mixing the dopamine with a solvent and a polymer substance. Here, each of the functional groups may be a negative charge functional group or a positive charge functional group.

In addition, in the mask having a built-in adsorptive membrane according to an embodiment of the present disclosure, the ion exchanged nanofibers may be coated with oil.

In addition, in the mask having a built-in adsorptive membrane according to an embodiment of the present disclosure, the first adsorptive member may be designed to be thinner than the support member.

In addition, in the mask having a built-in adsorptive membrane according to an embodiment of the present disclosure, one or both of the support member and the first adsorptive member may further comprise stitched silver yarn.

According to another aspect of the present invention, there is provided a mask having a built-in adsorptive membrane, the mask comprising: a mask body having an adsorptive membrane for adsorbing foreign substances contained in the air; and a hanger band fixed to the mask body to be hung and fixed to the ear, wherein the adsorptive membrane comprises: a support member having a plurality of first pores; a first adsorptive member stacked on an upper surface of the support member and having a plurality of second pores formed therein and made by accumulating ion exchange nanofibers for adsorbing foreign substances; and a second adsorptive member stacked on an upper surface of the first adsorptive member and having a plurality of third pores and made by accumulating nanofibers containing an antibacterial substance.

Here, the second and third pore sizes may be smaller than the first pore size, and the antibacterial substance may be a silver nanomaterial, and the second adsorptive member may have a nanofiber web structure formed by electrospinning a spinning solution prepared by dissolving the silver nanomaterial in an organic solvent together with a fiber formability polymer material.

In addition, the second pore size may be 3 μm or less.

Advantageous Effects

According to some embodiments of the present disclosure, since the adsorptive membrane built in the mask can adsorb a heavy metal ionic foreign substance and a heavy metal ultrafine foreign substance, there are advantages that the mask can increase the purification ability of the contaminated air, and the mask can be utilized as a mask for various purposes such as a medical mask, an industrial mask, and a living-use mask.

In addition, as described above, since the mask having a built-in adsorptive membrane according to some embodiments of the present disclosure is a structure for adsorbing and removing various foreign substances, it is possible to completely remove foreign substances even if the pore size is designed to be larger than that of a general mask. Therefore, when compared with a general mask, the mask having a built-in adsorptive membrane according to some embodiments of the present disclosure enables stable breathing and convenient use.

According to some embodiments of the present disclosure, the adsorptive member having the plurality of pores formed by the nanofibers is laminated on the support member having the plurality of pores to realize a membrane, thereby making it possible to improve the adsorption performance while preserving the passing flow rate.

According to some embodiments of the present disclosure, the adsorptive member and the support member can be laminated to have excellent handling properties and strength, and the production cost of the mask can be reduced with a low-cost adsorptive membrane, and the performance can be improved.

According to some embodiments of the present disclosure, there are advantages that heavy metals, bacteria, and viruses contained in a passing gas may be adsorbed by nanofiber webs that are formed by accumulating nanofibers containing dopamine to which a functional group is attached, in which the nanofiber webs are included in the membrane.

According to some embodiments of the present disclosure, the membrane contains the adsorptive member formed by accumulating nanofibers containing a large number of pores and antibacterial substances, or the membrane undergoes a silver yarn stitching process, to thus improve an antibacterial property.

BEST MODE

Hereinafter, embodiments of the present invention will be described in detail with reference to the accompanying drawings.

In some embodiments of the present disclosure, a mask having a built-in adsorptive membrane for adsorbing foreign substances contained in the air is implemented, and heavy metal ionic foreign substances and large-sized heavy metal foreign substances can be adsorbed by the adsorptive membrane built in the mask. Therefore, users wearing the mask can breathe with purified air.

In addition, the mask according to some embodiments of the present disclosure has a filtration mechanism that adsorbs and removes various foreign substances. Accordingly, even when the pore size is larger than that of a general mask, filtering of foreign substances is performed perfectly and the advantage of easy breathing is obtained.

Contaminated air means, for example, air containing allergens such as pathogenic microorganisms and pollen, industrial dusts such as coal and metal powders, fine dusts caused by yellow sand, viruses, and bacteria. When the mask according to some embodiments of the present disclosure is not worn by a person, harmful components of the contaminated air are penetrated into the body of the person by respiration.

Therefore, the mask according to some embodiments of the present disclosure can be utilized as a mask for various purposes such as a medical mask, an industrial mask, and a living mask for yellow sand.

Figure 1:
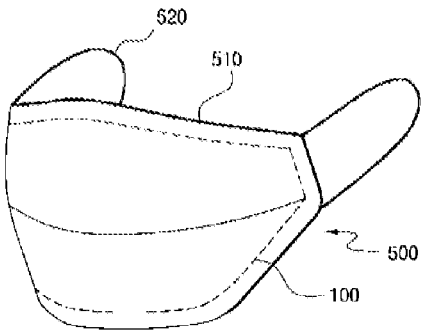
FIG. 1 is a perspective view of a mask having a built-in adsorptive membrane according to an embodiment of the present disclosure.

Referring to FIG. 1, a mask 500 having a built-in adsorptive membrane according to an embodiment of the present disclosure includes: a mask body 510 having a built-in adsorptive membrane 100; and a hanger band 520 fixed to the mask body 510 and hung and fixed to the ear.

Figure 2:
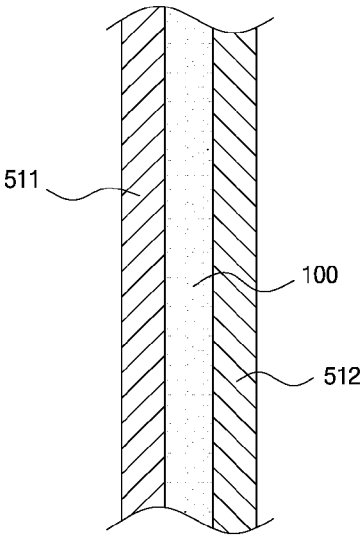
FIG. 2 is a cross-sectional view of a mask body using an adsorptive membrane according to an embodiment of the present disclosure.

As shown in FIG. 2, the mask body 510 includes an outer skin 511 exposed to the external air; an inner skin 512 fixed to the outer skin 511 and contacting the face; and an adsorptive membrane 100 disposed between the outer skin 511 and the inner skin 512.

Here, the outer skin 511 and the inner skin 512 are fixed to each other by stitching or thermal fusion at the edge regions of the outer skin 511 and the inner skin 512, and are spaced apart from each other to form a spatial area in the inner sides formed by of the outer skin 511 and the inner skin 512, in which the adsorptive membrane 100 is contained in the spatial area.

The outer skin 511 and the inner skin 512 may be made of a material having pores through which the air transferred from the outside of the mask can pass. The outer skin 511 and the inner skin 512 may be formed of the same material or different materials.

For example, the outer skin 511 and the inner skin 512 may employ a fabric using warp and weft yarns. The outer skin 511 may be made of a material that is not easily deformed, deteriorated, or abraded by the rough external air. The inner skin 511 may be made of a material that does not cause side effects on the contact face.

Figure 3:
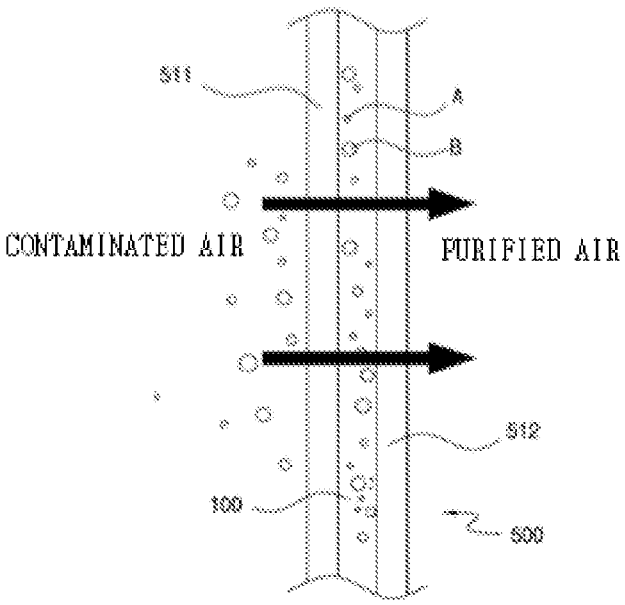
FIG. 3 is a view for explaining the principle of purifying air in a mask using an adsorptive membrane according to an embodiment of the present disclosure.

Therefore, the mouth and nose are masked by and covered with the mask 500 having the built-in adsorptive membrane according to the embodiment of the present disclosure as shown in FIG. 3. Accordingly, when the contaminated air outside the mask 500 is inhaled by inhalation through the mouth and nose, the contaminated air passes through the adsorptive membrane 100 built in the mask 500 to become purified air, and the wearer of the mask 500 can breathe healthily with the purified air.

That is, when the wearer of the mask 500 performs an inhalation for breathing, the contaminated air from the outside is transferred to the adsorptive membrane 100 through the outer skin 511 of the mask 500.

The adsorptive membrane 100 adsorbs the ionic foreign substances A contained in the contaminated air and the foreign substances B having a size larger than the pore size of the adsorptive membrane 100 to supply the purified air to the wearer's mouth or the nose, through the inner skin 512. Therefore, the wearer can perform breathing with the harmless air from which the pollutants are removed, thereby maintaining a healthy life.

Figure 4:
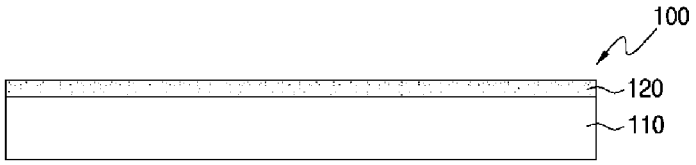
FIG. 4 is a cross-sectional view of an adsorptive membrane applied to a mask according to a first embodiment of the present disclosure.

Referring to FIG. 4, the adsorptive membrane 100 applied to the mask according to the first embodiment of the present disclosure includes: a support member 110 having a plurality of first pores; and an adsorptive member 120 which is stacked on the support member 110 and has a plurality of second pores formed therein, and which is made by accumulating ion exchange nanofibers for adsorbing foreign substances.

The adsorptive membrane 100 absorbs ionic foreign substances by the ion exchange nanofibers of the adsorptive member 120 and physically filters the foreign substances (for example, dirt, dust, debris, particles, etc.) having a size larger than the pore size by the first pores of the support member 110 and the second pores of the adsorptive member 120, to thus enhance the removal efficiency of the foreign substances.

Figure 5:
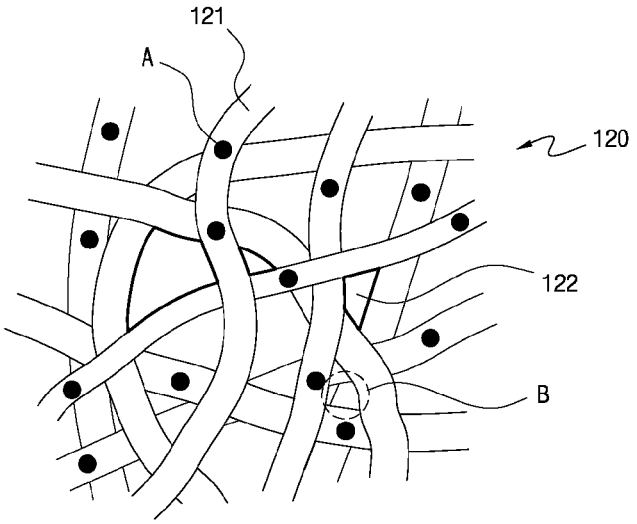
FIG. 5 is a schematic view for explaining the principle of adsorption of foreign substances to an adsorptive member of an adsorptive membrane applied to a mask according to an embodiment of the present disclosure.

In other words, as shown in FIG. 5, when the air passes through the adsorptive membrane 100, the ionic foreign substances A contained in the air are adsorbed by the ion exchange nanofibers 121 of the adsorptive member 120, and the large-size foreign substances B included in the air do not pass through the second pores 122 of the adsorptive member 120 and are trapped inside the adsorptive member 120. As a result, the foreign substances A and B are restrained in the adsorption state (the state that the foreign substances do not escape from but stick to the inside of the adsorptive member 120) in the adsorptive membrane 100, and thus the filtering performance of the adsorptive membrane 100 according to some embodiments of the present disclosure may be increased.

Therefore, the adsorptive membrane applied to the mask according to an embodiment of the present disclosure is not a non-porous membrane structure, and is realized by laminating an adsorptive member having a plurality of pores made by nanofibers on a support member having a plurality of pores, to thereby provide some advantages of enhancing an adsorption performance while preserving the flow rate.

Also, in some embodiments of the present disclosure, the large-size foreign substances B contained in the air cannot pass through the first pores of the support member 110, but are trapped inside the adsorptive membrane 100, so that the adsorption ability can be further improved. Here, the first pore size of the support member 110 is preferably larger than the second pore size 122 of the adsorptive member 120.

The support member 110 serves as a passageway for passing the air through the plurality of first pores and serves as a support layer for supporting the adsorptive member 120 to maintain the flat plate shape. Here, the support member 110 is preferably a nonwoven fabric or a woven fabric.

The usable nonwoven fabric may be any one of a melt-blown nonwoven fabric, a spun bond nonwoven fabric, a thermal bond nonwoven fabric, a chemical bond nonwoven fabric, and a wet-laid nonwoven fabric. The fiber diameter of the nonwoven fabric may be 40 μm to 50 μm, and the pore size thereof may be 100 μm or more.

In addition, in some embodiments of the present disclosure, since the adsorptive member 120 made by accumulating ion exchange nanofibers has poor handleability and strength, the adsorptive member 120 and the support member 110 are laminated to thereby implement an adsorptive membrane having excellent handleability and strength.

Meanwhile, since the adsorptive member 120 made by accumulating the ion exchange nanofibers is expensive, implementing of the adsorptive membrane 100 in some embodiments of the present disclosure only by using the sole adsorptive member 120, requires a lot of manufacturing cost. Therefore, in some embodiments of the present disclosure, it is possible to reduce the manufacturing cost by stacking the supporting member, which is much cheaper than the adsorptive member 120 made by accumulating the ion exchange nanofibers, on the adsorptive member 120. In this case, the expensive adsorptive member 120 is designed to be thin and the low-priced support member 110 is designed to be thick, so that the manufacturing cost can be optimized at low cost.

In some embodiments of the present disclosure, an ion exchange solution is electrospun to discharge ion exchange nanofibers to the support member, and the discharged ion exchange nanofibers are accumulated in the support member 110 to produce the adsorptive member 120.

The ion exchange solution can be defined as a solution synthesized by a synthesis process such as bulk polymerization of a polymer, a solvent and ion exchange functional groups.

Since the ion exchange functional groups are contained in the ion exchange nanofibers, ionic foreign substances such as heavy metals contained in the air passing through the adsorptive membrane 100 are exchanged by substitution and adsorbed to the ion exchange functional groups. As a result, the ionic foreign substances are adsorbed to the ion exchange nanofibers by the ion exchange functional groups.

For example, when the ion exchange functional groups are $SO_3H$, and/or $NH_4CH_3$, the ionic foreign substances (for example, ionic heavy metal positive ions or heavy metal negative ions) contained in water are replaced with $H^+$ and/or $CH_3^+$ by substitution, and adsorbed to the ion exchange functional groups.

Here, the ion exchange functional groups include a cation exchange functional group selected from a sulfonic acid group, a phosphoric acid group, a phosphonic group, a phosphonic group, a carboxylic acid group, an arsonic group, a selenonic group, an iminodiacetic acid group and a phosphoric acid ester group; or an anion exchange functional group selected from a quaternary ammonium group, a tertiary amino group, a primary amino group, an imine group, a tertiary sulfonium group, a phosphonium group, a pyridyl group, a carbazolyl group and an imidazolyl group.

Here, the polymer is a resin that is capable of being electrospun, capable of being dissolved in an organic solvent for electrospinning, and capable of forming nanofibers by electrospinning, but is not particularly limited thereto. For example, the polymer may include: polyvinylidene fluoride (PVdF), poly (vinylidene fluoride-co-hexafluoropropylene), perfluoropolymers, polyvinyl chloride, polyvinylidene chloride, or co-polymers thereof; polyethylene glycol derivatives containing polyethylene glycol dialkylether and polyethylene glycol dialkyl ester; polyoxide containing poly (oxymethylene-oligo-oxyethylene), polyethylene oxide and polypropylene oxide; polyacrylonitrile co-polymers containing polyvinyl acetate, poly (vinyl pyrrolidone-vinyl acetate), polystyrene and polystyrene acrylonitrile co-polymers, polyacrylonitrile (PAN), or polyacrylonitrile methyl methacrylate co-polymers; or polymethyl methacrylate and polymethyl methacrylate co-polymers, or a mixture thereof.

In addition, examples of the usable polymer may include: aromatic polyester such as polyamide, polyimide, polyamide-imide, poly (meta-phenylene iso-phthalamide), polysulfone, polyether ketone, polyethylene terephthalate, polytrimethylene terephthalate, and polyethylene naphthalate; polyphosphazenes such as polytetrafluoroethylene, polydiphenoxy phosphazene, and poly {bis [2-(2-methoxyethoxy) phosphazene]}; polyurethane co-polymers including polyurethane and polyether urethane; cellulose acetate, cellulose acetate butylrate, cellulose acetate propionate, and the like.

As the polymer preferable for the adsorptive member, PAN, polyvinylidene fluoride (PVdF), polyester sulfone (PES) and polystyrene (PS) may be used alone or a mixture of polyvinylidene fluoride (PVdF) and polyacrylonitrile (PAN), or a mixture of PVDF and PES, and a mixture of PVdF and thermoplastic polyurethane (TPU) may be used.

As the solvent, a mono-component solvent such as dimethylformamide (DMF) can be used. However, when a two-component solvent is used, it is preferable to use a two-component solvent in which a high boiling point (BP) solvent and a low boiling point (BP) solvent are mixed with each other.

As described above, a plurality of ultrafine pores (i.e., second pores) are formed between the ion exchange nanofibers that are accumulated randomly in the adsorptive member 120 which is formed by accumulating the ion exchange nanofibers in the support member 110. Although the micro pore size is not limited, the filtration mechanism according to some embodiments of the present disclosure adsorbs and removes foreign substances. Thus, even if the pore size is larger than that of a general mask, there is no problem in filtration performance. It has a very convenient advantage in respiration. Even if the pore size is about 3 μm or so, even about 10 μm or so, and the porosity is 50% to 90%, perfect filtration becomes possible.

The diameter of each of the ion exchange nanofibers is preferably in the range of 0.1 μm to 10.0 μm, and the thickness of the adsorptive member 120 is freely adjusted according to a spinning time from an electrospinning apparatus. The pore size is determined according to the thickness of the adsorptive member 120.

The ion exchange nanofibers can be defined as having ion exchange functional groups having ion exchange ability on the surface thereof. Depending on the ions exchanged in the ion exchange functional groups, the ion exchange nanofibers can be cation exchange nanofibers or anion exchange nanofibers.

The adsorptive member 120 formed by accumulating the ion exchange nanofibers is a web structure of ion exchange nanofibers. The web is ultra-thin, ultra-light in weight, and large in specific surface area.

In some embodiments of the present disclosure, the ion exchange nanofibers are accumulated in the support member 110 by electrospinning the ion exchange nanofibers to form the adsorptive member 120, thereby increasing a coupling force between the support member 110 and the absorptive member 120. Accordingly, there is an advantage that the adsorptive member 120 can be prevented from being peeled off from the support member 110 by external force.

Figure 6:
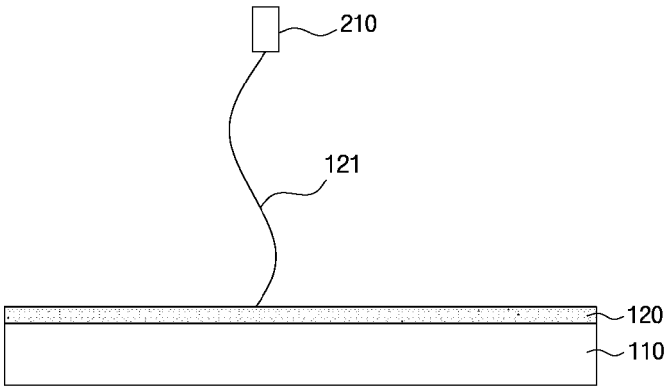
FIG. 6 is a view schematically showing a state in which ion exchange nanofibers are accumulated by electrospinning a spinning solution to a support member according to an embodiment of the present disclosure.

In other words, as shown in FIG. 6, the ion exchange nanofibers 121 discharged from a spinning nozzle 210 of the electrospinning apparatus are stacked on the supporting member 110, and the stacked ion exchange nanofibers 121 are accumulated, and thus a web-shaped adsorptive member 120 is formed.

FIGS. 7 to 10 are cross-sectional views of the adsorptive membrane applied to the gas filter according to the second to fifth embodiments of the present disclosure, respectively.

Figure 7:
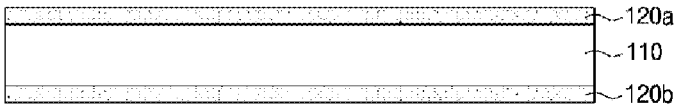
FIG. 7 is a cross-sectional view of an adsorptive membrane applied to a mask according to a second embodiment of the present disclosure.

Referring to FIG. 7, an adsorptive membrane applied to a mask according to the second embodiment of the present disclosure includes: a support member 110 having a plurality of first pores; a first adsorptive member 120*a* stacked on an upper surface of the support member 110 and having a plurality of second pores formed therein and made by accumulating ion exchange nanofibers for adsorbing foreign substances; and a second adsorptive member 120*b* stacked on a lower surface of the support member 110 and having a plurality of third pores formed therein and made by accumulating ion exchange nanofibers for adsorbing foreign substances.

The adsorptive membrane applied in a mask according to the second embodiment is configured to include first and second adsorptive members 120*a* and 120*b* that are laminated on both sides of the support member 110 to adsorb the ionic foreign substances not adsorbed by the first adsorption member 120*a*, and foreign substances having pore sizes larger than the pore sizes of the third pores by the second adsorptive member 120*b*, thereby increasing the adsorption efficiency of foreign substances.

Here, the first pore size may be designed to be the largest, the second pore size may be designed to have an intermediate size between the first pore size and the third pore size, and the third pore size may be designed to be the smallest.

Figure 8:
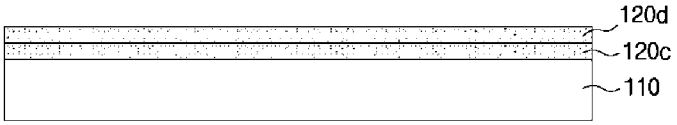
FIG. 8 is a cross-sectional view of an adsorptive membrane applied to a mask according to a third embodiment of the present disclosure.

Referring to FIG. 8, an adsorptive membrane applied to a mask according to the third embodiment of the present disclosure includes: a support member 110 having a plurality of first pores; a first adsorptive member 120*c* stacked on an upper surface of the support member 110 and having a plurality of second pores formed therein and made by accumulating first ion exchange nanofibers for adsorbing foreign substances; and a second adsorptive member 120*d* stacked on an upper surface of the first adsorptive member 120*c* and having a plurality of third pores formed therein and made by accumulating second ion exchange nanofibers for adsorbing foreign substances.

The first ion exchange nanofibers of the first adsorptive member 120*c* may be cation exchange nanofibers or anion exchange nanofibers, and the second ion exchange nanofibers of the second adsorptive member 120*d* may be nanofibers that exchange ions of opposite polarity to the first ion exchange nanofibers. That is, when the first ion exchange nanofibers are cation exchange nanofibers, the second ion exchange nanofibers are anion exchange nanofibers.

Therefore, the adsorptive membrane applied in a mask according to the third embodiment is advantageous in that both the cation heavy metal and anion heavy metal contained in the passing air can be adsorbed by the first and second adsorptive members 120*c* and 120*d*.

Figure 9:
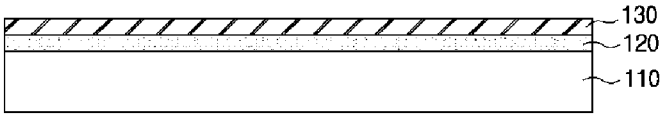
FIG. 9 is a cross-sectional view of an adsorptive membrane applied to a mask according to a fourth embodiment of the present disclosure.

Referring to FIG. 9, an adsorptive membrane applied to a mask according to the fourth embodiment of the present disclosure includes: a support member 110 having a plurality of first pores; a first adsorptive member 120 stacked on an upper surface of the support member 110 and having a plurality of second pores formed therein and made by accumulating ion exchange nanofibers for adsorbing foreign substances; and a second adsorptive member 130 stacked on an upper surface of the first adsorptive member 120 and having a plurality of third pores formed therein and made by accumulating nanofibers containing an antibacterial substance.

The adsorptive membrane applied in the gas filter according to the fourth embodiment can adsorb ionic foreign substances by the ion exchange nanofibers of the first adsorptive member 120 and can have the antibacterial property by the nanofibers containing the antibacterial substance of the second adsorptive member 130.

Here, the second and third pore sizes are preferably designed to be smaller than the first pore size.

The adsorptive membrane can also physically filter and adsorb foreign substances having a size larger than the pore size in each of the first to third pores.

Here, the antibacterial substances are preferably silver nano materials. Here, silver nano materials are silver (Ag) salts such as silver nitrate ($AgNO_3$), silver sulfate ($Ag_2SO_4$), and silver chloride (AgCl).

In some embodiments of the present disclosure, a silver nanomaterial is dissolved in an organic solvent together with a fiber formability polymer material to prepare a spinning solution, and the spinning solution is electrospun to obtain a second adsorptive member 130 of a nanofiber web structure formed by accumulating nanofibers containing an antibacterial substance.

In the adsorptive membrane applied in a mask according to the fifth embodiment of the present disclosure may further include a nanofiber web, which has a plurality of pores, and which is made by accumulating nanofibers containing dopamine having a functional group for adsorbing foreign substances. Here, the nanofiber web containing dopamine is preferably laminated on the adsorptive member.

Figure 10:
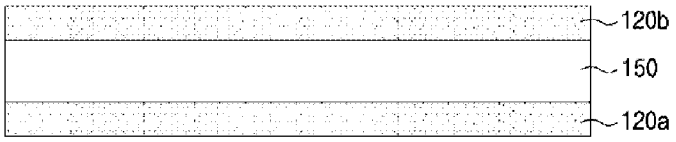
FIG. 10 is a cross-sectional view of an adsorptive membrane applied to a mask according to a fifth embodiment of the present disclosure.

For example, as shown in FIG. 10, the adsorptive membrane may be implemented by interposing a nanofiber web 150 between the first and second adsorptive members 120*a* and 120*b*, in which the nanofiber web 150 is made by accumulating nanofibers having a plurality of pores formed and containing dopamine, to which a functional group capable of adsorbing foreign substances is attached.

Here, the first and second adsorptive members 120*a* and 120*b* are adsorptive members formed by accumulating ion exchange nanofibers having a plurality of pores and adsorbing foreign substances, and the nanofiber web 150 is produced by electrospinning a spinning solution which is made by mixing a dopamine monomer or polymer, a solvent and a polymer substance.

Dopamine (i.e. 3,4-dihydroxyphenylalamine) has a structure in which —$NH_2$ and —OH are bonded to a benzene ring.

The functional groups attached to the dopamine contained in the nanofibers can be formed by a post-treatment such as UV irradiation, plasma treatment, acid treatment, and base treatment after forming a nanofiber web containing a dopamine monomer or polymer. Finally, the nanofiber web containing dopamine is in a state where the functional group is attached to the nanofiber.

Here, the functional group can function as a negative charge functional group such as $SO_3H^-$ or a positive charge functional group such as $NH_4^+$ to adsorb heavy metals, bacteria and viruses. Thus, the adsorptive membrane applied in a mask according to the fifth embodiment of the present disclosure can filter heavy metals, bacteria and viruses contained in the passing air and adsorb the filtered heavy metals, bacteria and viruses inside the adsorptive membrane.

In the mask according to the above-described embodiment, the dopamine-containing nanofiber layer is preferably formed with a wetting layer for forming a certain moisture environment because dopamine functions in an environment in which constant moisture is present. In other words, it is good to arrange the wetting layer that keeps the water environment to a certain degree by gathering the moisture of the breath that occurs when the person breathes.

Figure 11:
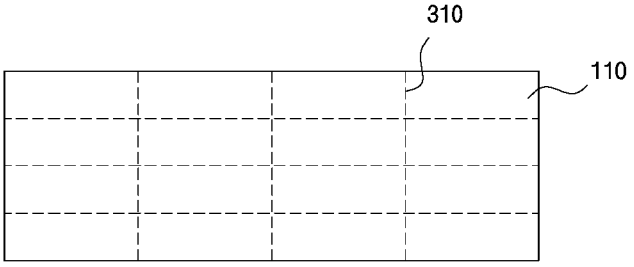
FIG. 11 is a schematic plan view for explaining a state in which a silver yarn stitching process is applied on an adsorptive membrane applied to a mask according to an embodiment of the present disclosure.

FIG. 11 is a schematic plan view for explaining a state in which a silver yarn stitching process is applied on an adsorptive membrane applied to a mask according to an embodiment of the present disclosure.

According to the embodiments of the present disclosure, the adsorptive membrane including the support member can be subjected to a silver yarn stitching process to realize an adsorptive membrane having antibacterial properties by the stitched silver yarn. Here, the silver yarn stitching process may be performed on one or both of the support member and the adsorptive member of the adsorptive membrane.

Here, since the adsorptive member of the adsorptive membrane has a relatively lower strength than the support member, if the silver yarn is stitched to the adsorptive member, damage to the adsorptive member may be caused by the stitched silver yarn.

Meanwhile, the support member has strength enough to withstand the silver yarn stitching process, thereby stitching the silver yarn 310 on the support member 110, as shown in FIG. 11. In this case, it is preferable that the silver yarn 310 is stitched in a lattice pattern, but it is not limited thereto.

The silver yarn is a thread made of silver. The silver yarn stitched to the support member 110 can kill the bacteria contained in the passing air, and the adsorptive membrane can have a strong antibacterial property.

Meanwhile, in some embodiments of the present disclosure, the nanofibers of the adsorptive member of the adsorptive membrane of the above-described embodiments may be coated with oil such as glycerin.

Since the adsorptive member has a web shape in which ion exchange nanofibers are accumulated, the nanofibers are coated with oil in order to activate adsorption of ion exchange functional groups present on the surfaces of ion exchange nanofibers, to thereby adsorb ionic foreign substances by the oil, and then by the exchange functional groups.

While the present invention has been particularly shown and described with reference to exemplary embodiments thereof, by way of illustration and example only, it is clearly understood that the present invention is not to be construed as limiting the present invention, and various changes and modifications may be made by those skilled in the art within the protective scope of the invention without departing off the spirit of the present invention.

INDUSTRIAL APPLICABILITY

The present disclosure is a mask having a built-in adsorptive membrane capable of adsorbing ionic foreign substances and ultrafine size foreign substances, thereby improving the purification performance of contaminated air, and being used as a mask for various purposes.

What is claimed is:

1. A mask having a built-in adsorptive membrane, the mask comprising:

a mask body having a built-in adsorptive membrane for adsorbing foreign substances contained in air; and a hanger band fixed to the mask body to be hung and fixed to a user's ear, wherein the built-in adsorptive membrane comprises:

a support member having a plurality of first pores formed therein; and a first adsorptive member that is stacked on an upper surface of the support member and has a plurality of second pores formed therein, wherein the first adsorptive member is formed of first accumulated ion exchange nanofibers for adsorbing ionic foreign substances in the foreign substances, and the first accumulated ion exchange nanofibers are formed of a mixture of a first ion exchange material and dopamine having a functional group, wherein at least one of the support member and the first adsorptive member is stitched with a silver yarn.

2. The mask of claim 1, wherein the mask body has an outer skin exposed to an external air; and an inner skin to be in contact with a user's face, wherein the built-in absorptive membrane is disposed between the outer skin and the inner skin.

3. The mask of claim 1, wherein the foreign substances contained in the air includes at least one of pathogenic microorganisms, allergens, industrial dusts, fine dusts caused by yellow sand, viruses, and bacteria.

4. The mask of claim 1, wherein the support member is formed of a nonwoven fabric or a woven fabric.

5. The mask of claim 1, wherein the first pores have a pore size larger than that of the second pores.

6. The mask of claim 1, wherein the first accumulated ion exchange nanofibers are cation exchange nanofibers or anion exchange nanofibers.

7. The mask of claim 1, further comprising: a second adsorptive member which is stacked on a lower surface of the support member and has a plurality of third pores formed therein, wherein the second adsorptive member is formed of second accumulated ion exchange nanofibers for adsorbing ionic substances in the foreign substances, and the second accumulated ion exchange nanofibers have a polarity opposite to that of the first accumulated ion exchange nanofibers.

8. The mask of claim 7, wherein the first pores have a pore size larger than those of the second pores and the third pores, and the pore size of the second pores is larger than that of the third pores, thereby the second adsorptive member being capable of effectively adsorbing foreign substances including ionic foreign substances passing through the support member and the first adsorptive member.

9. The mask of claim 7, wherein the first accumulated ion exchange nanofibers or the second accumulated ion exchange nanofibers are coated with oil.

10. The mask of claim 1, wherein the built-in adsorptive membrane further comprises: a wetting layer for maintaining a predetermined moisture state thereof.

* * * * *